US009803863B2

(12) United States Patent
Johnson et al.

(10) Patent No.: US 9,803,863 B2
(45) Date of Patent: Oct. 31, 2017

(54) CONTROLLED-LEAK COMBUSTOR GROMMET

(71) Applicant: Solar Turbines Incorporated, San Diego, CA (US)

(72) Inventors: Crosby Hayhurst Johnson, San Diego, CA (US); Yong Weon Kim, San Diego, CA (US); Ted Edwin Groocock, Chula Vista, CA (US)

(73) Assignee: Solar Turbines Incorporated, San Diego, CA (US)

( * ) Notice: Subject to any disclaimer, the term of this patent is extended or adjusted under 35 U.S.C. 154(b) by 357 days.

(21) Appl. No.: 14/711,628

(22) Filed: May 13, 2015

(65) Prior Publication Data

US 2016/0334102 A1 Nov. 17, 2016

(51) Int. Cl.

| | |
|---|---|
| ***F02C 7/20*** | (2006.01) |
| ***F23R 3/00*** | (2006.01) |
| ***F23R 3/06*** | (2006.01) |
| ***F23R 3/50*** | (2006.01) |
| ***F23R 3/04*** | (2006.01) |

(52) U.S. Cl.

CPC ..... *F23R 3/002* (2013.01); *F23R 3/045* (2013.01); *F23R 3/06* (2013.01); *F23R 3/50* (2013.01); *F23R 2900/00012* (2013.01); *F23R 2900/00014* (2013.01)

(58) Field of Classification Search

CPC .. F23R 2900/00012; F23R 2900/00014; F23R 3/002; F23R 3/045; F23R 3/06; F23R 3/50; F23R 3/04; F23R 3/60

See application file for complete search history.

(56) References Cited

U.S. PATENT DOCUMENTS

| | | | | |
|---|---|---|---|---|
| 7,013,634 | B2 * | 3/2006 | Pidcock | F23R 3/002 60/39.821 |
| 8,056,346 | B2 | 11/2011 | Lockyer et al. | |
| 8,479,490 | B2 * | 7/2013 | Zupanc | F02C 7/264 60/39.821 |
| 9,587,831 | B2 * | 3/2017 | Jause | F02C 7/20 |
| 2003/0163995 | A1 * | 9/2003 | White | F23R 3/002 60/800 |
| 2005/0198966 | A1 | 9/2005 | Boardman | |
| 2009/0064657 | A1 | 3/2009 | Zupanc et al. | |
| 2010/0212324 | A1 * | 8/2010 | Bronson | F02C 7/264 60/752 |

(Continued)

FOREIGN PATENT DOCUMENTS

| | | |
|---|---|---|
| WO | 2014055116 | 4/2014 |
| WO | 2014112992 | 7/2014 |
| WO | 2015039074 | 3/2015 |

*Primary Examiner* — Jesse Bogue

(74) *Attorney, Agent, or Firm* — Procopio, Cory, Hargreaves & Savitch LLP

(57) ABSTRACT

A grommet for a combustor of a gas turbine engine is disclosed. The grommet includes a lower platform and a raised platform. The lower platform includes a plurality of top slots located in the top surface and a plurality of bottom slots located in the bottom surface. Each top slot and bottom slot may extend radially along the lower platform. The plurality of top slots may be spaced equidistantly from one another along the circumference of the lower platform. The plurality of bottom slots may be spaced equidistantly from one another along the circumference of the lower platform.

20 Claims, 3 Drawing Sheets

(56) References Cited

U.S. PATENT DOCUMENTS

| | | | | |
|---|---|---|---|---|
| 2011/0113747 | A1* | 5/2011 | Lains | F02C 7/266 60/39.821 |
| 2012/0102963 | A1* | 5/2012 | Corr | F23R 3/002 60/772 |
| 2013/0025287 | A1 | 1/2013 | Cunha | |
| 2013/0255269 | A1 | 10/2013 | McKenzie et al. | |
| 2014/0007580 | A1* | 1/2014 | Richardson | F23R 3/02 60/754 |
| 2014/0083112 | A1 | 3/2014 | Jause et al. | |
| 2015/0354818 | A1* | 12/2015 | Lebel | F23R 3/002 60/796 |

* cited by examiner

CONTROLLED-LEAK COMBUSTOR GROMMET

TECHNICAL FIELD

The present disclosure generally pertains to gas turbine engines, and is directed toward a grommet assembly for combustion chamber of a gas turbine engine.

BACKGROUND

Gas turbine engines include compressor, combustor, and turbine sections. A grommet may be located in a combustor liner to provide access into the area where the combustion process occurs, as well as to provide cooling to the combustor liner.

U.S. Patent App. Pub. No. 2014/0083112 to Jause et al. discloses a combustor liner grommet that may include a peripheral wall defining a hole in a combustor liner and further including at least one cooling air flow channel. The cooling air flow channel in the grommet wall may be a slot or a hole. The channel may increase cooling flow to the grommet and the combustor liner around the grommet to prevent cracking from heat stress.

The present disclosure is directed toward overcoming one or more of the problems discovered by the inventors or that is known in the art.

SUMMARY OF THE DISCLOSURE

A grommet for a combustor of a gas turbine engine is disclosed. The grommet includes a lower annular platform having a top surface, a bottom surface opposite the top surface, an outer surface extending between the top surface and the bottom surface at an outer circumferential end of the lower platform, and an inner circumferential end. The grommet further includes a collar extending from the top surface of the lower annular platform adjacent the inner circumferential end of the lower annular platform. The collar includes an outer surface located at an outer circumferential end of the collar, where the outer surface of the collar is circumferentially offset from the outer surface of the lower annular platform. The grommet further includes a plurality of top slots located in the top surface of the lower platform and a plurality of bottom slots located in the bottom surface of the lower platform. Each top slot and bottom slot extends radially from the outer surface of the collar to the outer surface of the lower platform. The plurality of top slots is spaced equidistantly from one another along the circumference of the lower platform, and the plurality of bottom slots are spaced equidistantly from one another along the circumference of the lower platform. Each top slot may be circumferentially offset from an adjacent bottom slot.

DETAILED DESCRIPTION

The systems and methods disclosed herein include a combustion chamber with a grommet assembly. The grommet assembly may assemble to an outer liner of the combustion chamber and a conduit extending through the outer liner. The grommet assembly may include a floating grommet that features a plurality of cooling slots. The cooling slots may provide an open passage for cooling air to be controlled and directed to certain hot spot regions of the outer liner.

Figure 1:
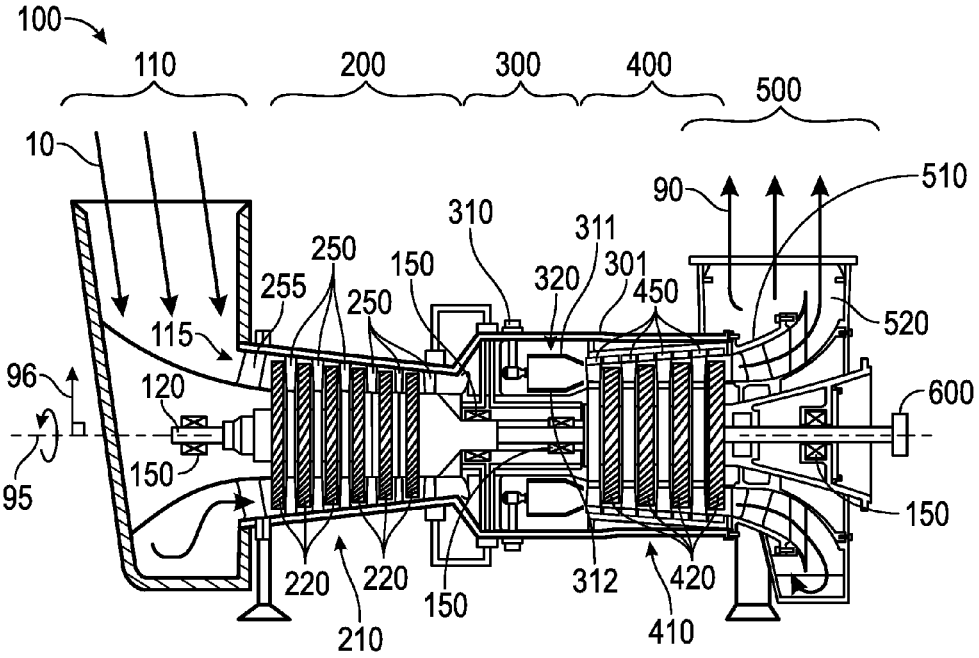
FIG. 1 is a schematic illustration of an exemplary gas turbine engine.

FIG. 1 is a schematic illustration of an exemplary gas turbine engine 100. Some of the surfaces have been left out or exaggerated (here and in other figures) for clarity and ease of explanation. Also, the disclosure may reference a forward and an aft direction. Generally, all references to "forward" and "aft" are associated with the flow direction of primary air (i.e., air used in the combustion process), unless specified otherwise. For example, forward is "upstream" relative to primary air flow, and aft is "downstream" relative to primary air flow.

In addition, the disclosure may generally reference a center axis 95 of rotation of the gas turbine engine, which may be generally defined by the longitudinal axis of its shaft 120 (supported by a plurality of bearing assemblies 150). The center axis 95 may be common to or shared with various other engine concentric components. All references to radial, axial, and circumferential directions and measures refer to center axis 95, unless specified otherwise, and terms such as "inner" and "outer" generally indicate a lesser or greater radial distance from center axis 95, wherein a radial 96 may be in any direction perpendicular and radiating outward from center axis 95.

A gas turbine engine 100 includes an inlet 110, a shaft 120, a compressor 200, a combustor 300, a turbine 400, an exhaust 500, and a power output coupling 600. The gas turbine engine 100 may have a single shaft or a dual shaft configuration.

The compressor 200 includes a compressor rotor assembly 210, compressor stationary vanes (stators) 250, and inlet guide vanes 255. The compressor rotor assembly 210 mechanically couples to shaft 120. As illustrated, the compressor rotor assembly 210 is an axial flow rotor assembly. The compressor rotor assembly 210 includes one or more compressor disk assemblies 220. Each compressor disk assembly 220 includes a compressor rotor disk that is circumferentially populated with compressor rotor blades. Stators 250 axially follow each of the compressor disk assemblies 220. Each compressor disk assembly 220 paired with the adjacent stators 250 that follow the compressor disk assembly 220 is considered a compressor stage. Compressor 200 includes multiple compressor stages. Inlet guide vanes 255 axially precede the compressor stages.

The combustor 300 includes one or more fuel injectors 310 and includes one or more combustion chambers 320. Combustion chamber 320 may include an outer liner 311 and an inner liner 312. Outer liner 311 may define the outer boundary of combustion chamber 320 and may generally include a hollow cylinder shape. Inner liner 312 may be located radially inward from outer liner 311. Inner liner 312 may define the inner boundary of combustion chamber 320 and may generally include a hollow cylinder shape. The fuel injectors 310 may be annularly arranged about center axis 95.

The turbine 400 includes a turbine rotor assembly 410 and turbine nozzles 450. The turbine rotor assembly 410 mechanically couples to the shaft 120. As illustrated, the turbine rotor assembly 410 is an axial flow rotor assembly. The turbine rotor assembly 410 includes one or more turbine disk assemblies 420. Each turbine disk assembly 420 includes a turbine disk that is circumferentially populated with turbine blades. Turbine nozzles 450 axially precede each of the turbine disk assemblies 420. Each turbine disk assembly 420 when paired with the adjacent turbine nozzles 450 that precede the turbine disk assembly 420 is considered a turbine stage. Turbine 400 may include multiple turbine stages.

The exhaust 500 includes an exhaust diffuser 510 and an exhaust collector 520. The power output coupling 600 may be located at an end of shaft 120.

Figure 2:
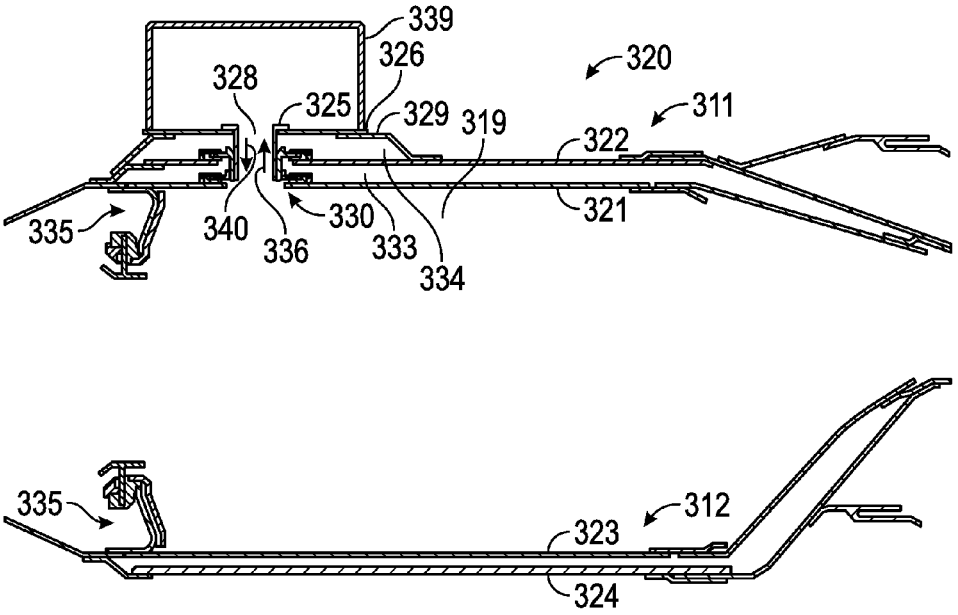
FIG. 2 is a cross sectional view of a portion of the combustion chamber 320 of FIG. 1.

FIG. 2 is a cross sectional view of a portion of the combustion chamber 320 of FIG. 1. Certain portions of the combustion chamber 320 are not shown for clarity. As illustrated, combustion chamber 320 may be a double walled chamber. In particular, outer liner 311 includes two liners: an exterior outer liner 322 and an interior outer liner 321. Exterior outer liner 322 may form an exterior barrier, and interior outer liner 321 may form an interior barrier. Interior outer liner 321 may be located radially inward from exterior outer liner 322, forming a cavity 333 with an annular shape there between. Similarly, inner liner 312 includes two liners: an interior inner liner 323 and an exterior inner liner 324. Exterior inner liner 324 may form an exterior barrier, and an interior inner liner 323 may form an interior barrier. Interior inner liner 323 may be located radially inward from exterior inner liner 324, forming an internal cavity with an annular shape there between. In addition, a combustion zone 319 may be located between interior outer liner 321 and interior inner liner 323.

Combustion chamber 320 may include a dome plate 335 located at the forward end of combustion chamber 320 where fuel and air are injected into the combustion chamber 320. Dome plate 335 may include an annular or toroidal shape. The axis of dome plate 335 may be concentric to center axis 95.

Combustion chamber 320 may include a conduit such as a tube 325 inserted through the exterior outer liner 322 and interior outer liner 321. Tube 325 may penetrate through both liners and form an opening into combustion zone 319. A channel 328 may extend between the inner walls of tube 325 and be in fluid communication with combustion zone 319. In some instances, combustion chamber 320 may include a plurality of tubes 325 inserted circumferentially about combustion chamber 320. During the combustion process, fuel may tend to flow in an outwards direction as indicated by arrow 336. Certain components, such as a resonator 339, may prevent or hinder fuel from flowing in the direction of arrow 336 as will be explained below.

In particular embodiments, resonator 339 may be coupled with combustion chamber 320. Resonator 339 may be assembled outside of tube 325. Resonator 339 may be located near a forward end of combustion chamber 320, and may be assembled to exterior outer liner 322. In some instances, a support bracket 326 may couple resonator 339 to exterior outer liner 322. Furthermore, an additional angled support bracket 329 may aid support bracket 326 in coupling resonator 339 to exterior outer liner 322. Support bracket 326 may be located radially outward from exterior outer liner 322, forming a channel 334 there between. Resonator 339 may be hollow structure such as a hollow cylinder featuring a cavity within. In some embodiments, resonator 339 is a hollow can. In some embodiments, resonator 339 includes a plurality of holes extending through the top surface or through the side walls of resonator 339. The plurality of holes may allow air flow from outside resonator 339 into resonator 339. This may purge fuel (or hot gas) away from the cavity of resonator 339 in an inwards direction as indicated by arrow 340. In addition, resonator 339 may be a cavity resonator which absorbs vibrational forces arising from the combustion process.

A grommet assembly 330 may be assembled to an annular component inserted into an opening through exterior outer liner 322 and interior outer liner 321. For example, grommet assembly 330 may be coupled to tube 325 in fluid communication with combustion zone 319. Grommet assembly 330 may protect tube 325 from vibrational forces and/or thermal expansion or contraction. In some embodiments, there is a plurality of grommet assemblies 330 assembled about the circumference of combustion chamber 320, each grommet assembly 330 coupled to a tube 325. In some embodiments, grommet assembly 330 is a resonator grommet assembly, a torch grommet assembly, an igniter grommet assembly, a flame sight grommet assembly, or a fuel injector grommet assembly.

Figure 3:
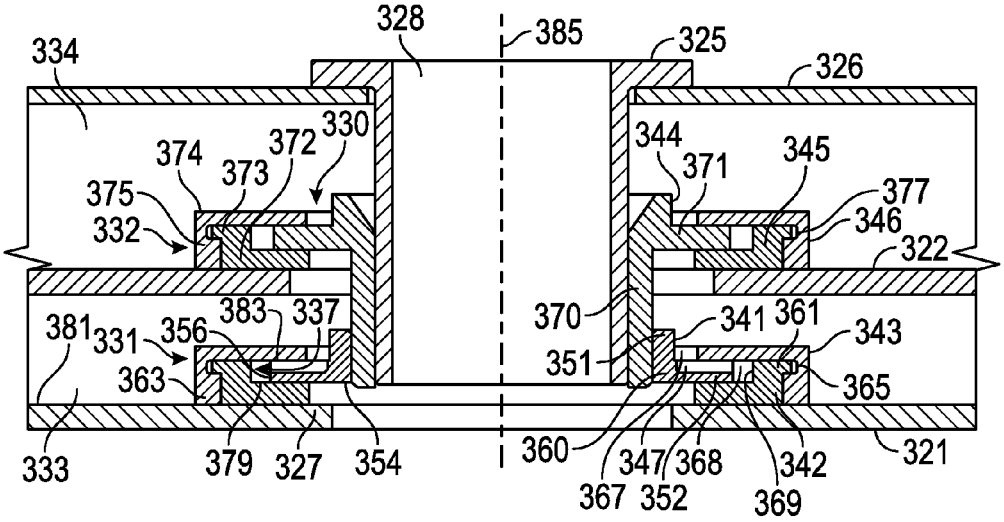
FIG. 3 is an enlarged view of the cross sectional portion of the combustion chamber of FIG. 2 around the resonator 339.
Figure 4:
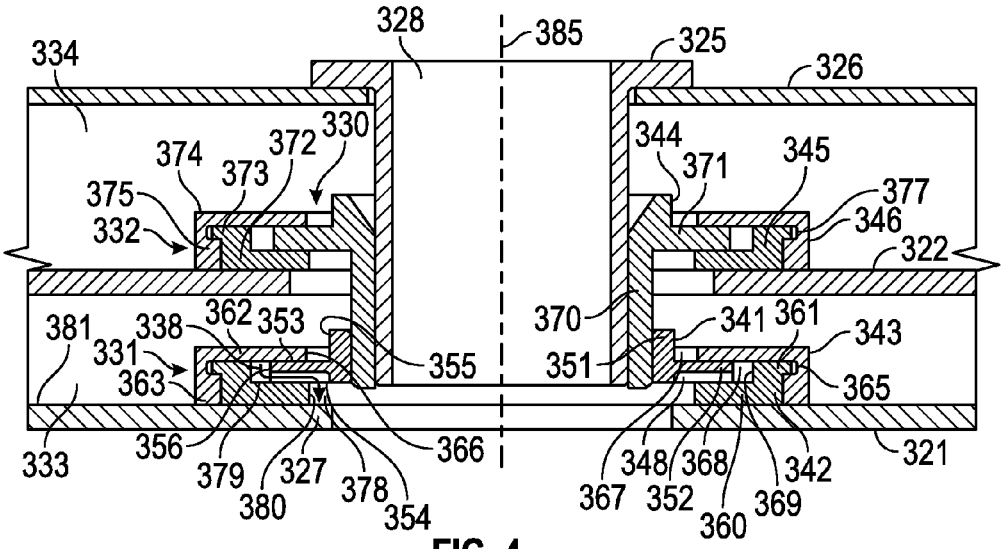
FIG. 4 is an enlarged view of the cross sectional portion of the combustion chamber of FIG. 2 around the resonator 339 at an angle offset compared to FIG. 3.
Figure 5:
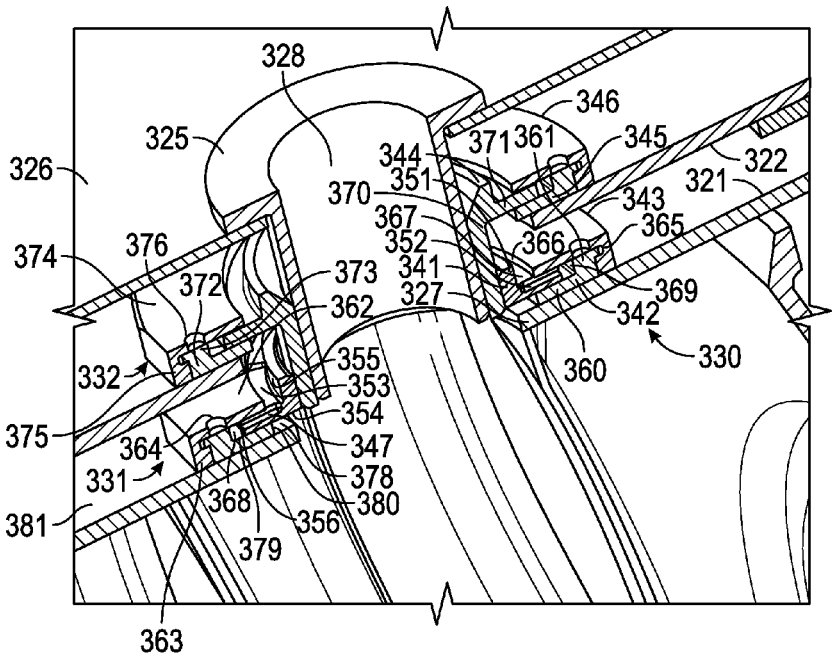
FIG. 5 is a perspective view of the portion of the combustion chamber of FIG. 3.

FIG. 3 is an enlarged view of the cross sectional portion of the combustion chamber of FIG. 2 around the resonator 339. FIG. 4 is an enlarged view of the cross sectional portion of the combustion chamber of FIG. 2 around the resonator 339 at an angle offset compared to FIG. 3. FIG. 5 is a perspective view of the portion of the combustion chamber of FIG. 3. As illustrated in FIG. 3-5, grommet assembly 330 may include two subassemblies: an inner grommet assembly 331 and an outer grommet assembly 332 (sometimes referred to as a second grommet assembly). Inner grommet assembly 331 may include a floating grommet 341 (sometimes referred to as a slotted cooling grommet), a retaining shroud 342, and a retaining nut 343. Outer grommet assembly 332 may include an elongated grommet 344, an outer retaining shroud 345, and an outer retaining nut 346.

Grommet assembly 330 may generally revolve about an assembly axis 385. Assembly axis 385 may be the central axis of tube 325. All references to radial, axial, and circumferential directions and measures with reference to grommet assembly 330 and its components refer to assembly axis 385 and terms such as "inner" and "outer" generally indicate a lesser or greater radial distance from assembly axis 385.

In some instances, retaining shroud 342 (sometimes referred to as a first fixture component) is an annular component featuring a base platform 360 and an upper platform 361 (sometimes referred to as an upper annulus). Base platform 360 may be an annular structure featuring an annular top surface 379, an annular bottom surface, and an inner surface 380 located at and defining an inner circumferential end of base platform 360. Upper platform 361 may also be an annular structure featuring an annular top surface and an annular bottom surface, as well as an inner surface 369 located at a circumferential end of upper platform 361. Upper platform 361 may extend axially upwards from a top surface 379 of base platform 360. Additionally, upper platform 361 may form a wall structure above an outer circumferential end of base platform 360. In some instances, retaining shroud 342 is a grommet. In addition, retaining shroud 342 may feature an outer surface that is threaded. In certain embodiments, base platform 360 is fixably attached to interior outer liner 321. Base platform 360 may be attached to interior outer liner 321 by brazing or welding. In certain embodiments, top surface 379 of base platform 360 may be a shelf that receives another component, such as floating grommet 341. Top surface 379 may be referred to as a receiving surface.

In some instances, retaining nut 343 (sometimes referred to as a second fixture component) is an annular component featuring a covering portion 362 and a wall portion 363 (sometimes referred to as a lower annular wall). Covering portion 362 may be an annular ceiling structure featuring an inner surface 366 located at one circumferential end of covering portion 362. In some instances, inner surface 366 is circular. Covering portion 362 may also include a hole 364 extending from the top surface of covering portion 362 (shown in FIG. 5). Hole 364 may be a screw hole configured to receive a fastener such as a screw, bolt, pin, or the like. In some instances, hole 364 is configured to be filled with an adhesive component such as a weld. In some instances, covering portion 362 includes a plurality of holes 364. Wall portion 363 may be a cylindrical wall extending below an outer circumferential end of covering portion 362. In some embodiments, an inner surface of wall portion 363 is threaded. Wall portion 363 may include a thread relief 365 in the inner surface of wall portion 363.

Retaining nut 343 may be fixably attached to retaining shroud 342. In some embodiments, retaining nut 343 is assembled above retaining shroud 342. In embodiments where the outer surface of retaining nut 343 is threaded, retaining nut 343 is threaded into the threaded inner surface of wall portion 363 of retaining shroud 342. In some embodiments, retaining nut 343 and retaining shroud 342 are fixed together by welding. In such embodiments, a weld is inserted into hole 364. In other embodiments, retaining nut 343 and retaining shroud 342 are fixed together by fastening a fastener through hole 364.

In some instances, floating grommet 341 is an annular component featuring a raised platform 351 (sometimes referred to as a cylindrical platform or a collar) and a lower platform 352 (sometimes referred to as a lower annular platform). Raised platform 351 may be a cylindrical collar extending from lower platform 352. In addition, raised platform 351 may include an outer surface 355. Lower platform 352 may be an annular disc structure featuring a top surface 353 and a bottom surface 354. Lower platform 352 may include an outer surface 356.

As shown in FIG. 3 and FIG. 5, a plurality of slots may be located in top surface 353. For example, top surface 353 may include at least one top slot 347. Top slot 347 may be a cylindrical groove extending a certain depth from top surface 353 towards bottom surface 354. Top slot 347 may extend radially along top surface 353. Furthermore, top slot 347 may extend radially from outer surface 355 of raised platform 351 to outer surface 356 of lower platform 352. In some embodiments, top slot 347 is a straight cylindrical shaped groove. In some embodiments, top slot 347 is a curved cylindrical shaped groove or a bent cylindrical shaped groove.

In certain embodiments, floating grommet 341 is not fixably attached to either retaining shroud 342 or to retaining nut 343. Floating grommet 341 may be positioned between base platform 360 of retaining shroud 342 and covering portion 362 of retaining nut 343. In particular, lower platform 352 of floating grommet 341 may radially extend between covering portion 362 and base platform 360. Raised platform 351 of floating grommet 341 may be radially spaced apart from covering portion 362. In some instances, floating grommet 341 is configured to thermally expand during operation of gas turbine engine 100.

Elongated grommet 344 may be a grommet featuring a shaft portion 370 and a flange portion 371. Shaft portion 370 may be an elongated annular structure featuring a circular top surface. Furthermore, shaft portion 370 may be assembled around tube 325. Flange portion 371 may be an annulus extending circumferentially outwards from shaft portion 370. In some instances, floating grommet 341 is secured against elongated grommet 344.

Outer retaining shroud 345 may include a similar structural configuration as retaining shroud 342. Outer retaining shroud 345 may be an annular component featuring a base platform 372 and an upper platform 373. Base platform 372 may be an annular structure featuring an annular top surface and an annular bottom surface. Upper platform 373 may also be an annular structure featuring an annular top surface and an annular bottom surface, as well as an inner surface located at one circumferential end of upper platform 373. Upper platform 373 may extend axially upwards from the top surface of base platform 372. Additionally, upper platform 373 may form a raised wall above base platform 372. In some instances, outer retaining shroud 345 is a grommet. In addition, outer retaining shroud 345 may feature an outer surface that is threaded. In certain embodiments, base platform 372 is fixably attached to interior outer liner 321. Base platform 372 may be attached to exterior outer liner 322 by welding or brazing. In certain embodiments, base platform 372 may be a shelf that receives another component, such as elongated grommet 344. Base platform 372 may be referred to as a receiving surface.

Outer retaining nut 346 may include a similar structural configuration as retaining nut 343. In some instances, outer retaining nut 346 is an annular component featuring a covering portion 374 and a wall portion 375. Covering portion 374 may be an annular ceiling structure featuring an inner surface located at one circumferential end of covering portion 374. Covering portion 374 may also include a hole 376 extending from the top surface of covering portion 374 (shown in FIG. 5). Hole 376 may be a screw hole configured to receive a fastener such as a screw, bolt, pin, or the like. In some instances, hole 376 is configured to be filled with an adhesive component such as a weld. In some instances, covering portion 374 includes a plurality of holes 376. Wall portion 375 may be a cylindrical wall extending below covering portion 374. Wall portion 375 may include a thread relief 377 in the inner surface of wall portion 375.

Outer retaining nut 346 may be fixably attached to outer retaining shroud 345. In some embodiments, outer retaining nut 346 is assembled above outer retaining shroud 345. In embodiments where the outer surface of outer retaining nut 346 is threaded, outer retaining nut 346 is threaded into the threaded inner surface of wall portion 375 of outer retaining shroud 345. In some embodiments, outer retaining nut 346 and outer retaining shroud 345 are fixed together by welding. In such embodiments, a weld is inserted into hole 376. In some embodiments, outer retaining nut 346 and outer retaining shroud 345 are fixed together by fastening a fastener through hole 376.

As illustrated, an upper gap 367 may be formed between outer surface 355 of floating grommet 341 and inner surface 366 of retaining nut 343. In certain instances, top slot 347 defines a passage for air flow between top slot 347 and bottom surface 383 of covering portion 374 of retaining nut 343. Additionally, air flow may enter into upper gap 367 and travel through top slot 347, as indicated by arrow 337. The air flow may be derived from air traveling within cavity 333, such as from impingement cooling holes extending through exterior outer liner 322 (not shown). Furthermore, air flow may continue to flow into a lower gap 368, also indicated by arrow 337. Lower gap 368 may be formed between outer surface 356 of floating grommet 341 and inner surface 369 of retaining shroud 342. In some embodiments, air flow path may continue to travel through lower gap 368 and into a bottom slot 348, as will be described in FIG. 4.

FIG. 4 illustrates grommet assembly 330 assembled with tube 325 in the same fashion as FIG. 3. Moreover, FIG. 4 depicts floating grommet 341 at a different angle as compared to floating grommet 341 shown in FIG. 3. In particular, FIG. 4 shows bottom slot 348 and does not show top slot 347. As will be described in FIG. 6 below, top slot 347 and bottom slot 348 may be circumferentially offset from one another.

In some instances, a plurality of slots may be located in bottom surface 354 of floating grommet 341. For example, bottom surface 354 may include at least one bottom slot 348. Bottom slot 348 may be a cylindrical shaped groove extending a certain depth from bottom surface 354 towards top surface 353. Bottom slot 348 may extend radially along bottom surface 354. Furthermore, bottom slot 348 may extend radially from outer surface 355 of raised platform 351 to outer surface 356 of lower platform 352. In some embodiments, bottom slot 348 is a straight cylindrical shaped groove. In some embodiments, bottom slot 348 is a curved cylindrical shaped groove.

In certain instances, bottom slot 348 defines a passage for air flow between bottom slot 348 and top surface 379 of base platform 360 of retaining shroud 342. Air flow may travel from lower gap 368 through bottom slot 348, as indicated by arrow 338. Air flow may continue to travel through bottom slot 348 and exit into an outlet region 378, also indicated by arrow 338. Outlet region 378 may be an opening formed between the bottom surface 354 of lower platform 352 of floating grommet 341, a top surface 381 of interior outer liner 321, and the inner surface 380 of retaining shroud 342. Air flow may also travel past an adjacent liner portion 327 (sometimes referred to as a hot spot area) and cool adjacent liner portion 327. In some embodiments, adjacent liner portion 327 is a portion of interior inner liner 321 directly adjacent to outlet region 378.

Figure 6:
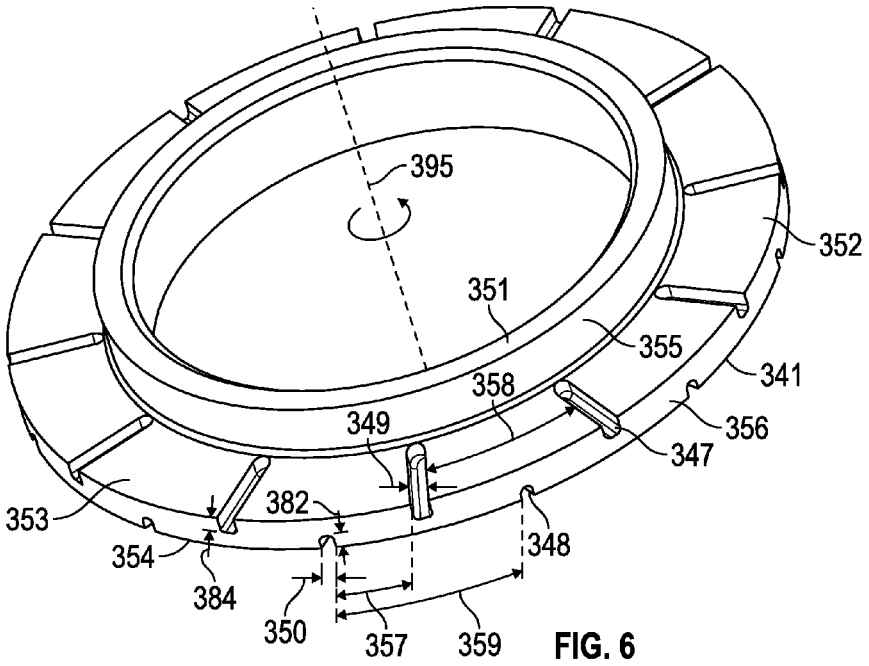
FIG. 6 is a perspective view of a grommet for a combustion chamber of a gas turbine engine.

FIG. 6 is a perspective view of a grommet for a combustion chamber of a gas turbine engine. In particular, FIG. 6 is a perspective view of floating grommet 341. As described above, floating grommet 341 may include a lower platform 352 and a raised platform 351. Raised platform 351 may extend upwards from top surface 353 of lower platform 352. Floating grommet 341 may generally revolve about an axis 395. All references to radial, axial, and circumferential directions and measures with reference to floating grommet 341 and its components refer to axis 395 and terms such as "inner" and "outer" generally indicate a lesser or greater radial distance from axis 395.

In certain instances, floating grommet 341 includes a plurality of top slots 347 and a plurality of bottom slots 348. In some instances, floating grommet 341 includes at least two top slots 347 and at least two bottom slots 348. In some instances, floating grommet 341 includes at least three top slots 347 and at least three bottom slots 348. In some instances, floating grommet 341 includes at least four top slots 347 and at least four bottom slots 348. In some instances, floating grommet 341 includes at least six top slots 347 and at least six bottom slots 348. In some instances, floating grommet 341 includes at least eight top slots 347 and at least eight bottom slots 348. In some instances, floating grommet 341 includes at least 12 top slots 347 and at least 12 bottom slots 348.

Each top slot 347 may feature a width 349. In some instances, width 349 ranges from 0.015" to 0.1". In some instances, width 349 is 0.04". Each bottom slot 348 may feature a width 350. In some instances, width 350 ranges from 0.015" to 0.1". In some instances, width 350 is 0.03".

Each top slot 347 may feature a depth 384. In some instances, depth 384 ranges from 0.015" to 0.1". In some instances, depth 384 is 0.04". Each bottom slot 348 may feature a depth 382. In some instances, depth 382 ranges from 0.015" to 0.1". In some instances, depth 382 is 0.03".

In certain embodiments, depth 384 and width 349 are of equal length. As such, each top slot 347 may feature a square cross section. In certain embodiments, depth 382 and width 350 are of equal length. As such, each bottom slot 348 may feature a square cross section.

Each top slot 347 may be separated from one another by a circumferential distance 358 equal to the circumference of lower platform 352 divided by the number of top slots. Each bottom slot 348 may be separated from one another by a circumferential distance 359 equal to the circumference of lower platform 352 divided by the number of bottom slots 348. In other words, each top slot 347 may be separated equidistantly from one another along the circumference of lower platform 352, and each bottom slot 348 may be separated equidistantly from one another along the circumference of lower platform 352. In particular embodiments, circumferential distance 358 ranges from 0.1" to 1.0". In particular embodiments, circumferential distance 359 is ranges from 0.1" to 1.0".

The position of each top slot 347 may be offset from an adjacent bottom slot 348 along the circumferential plane of lower platform 352. For instance, a top slot 347 may be spaced apart from a bottom slot 348 a circumferential distance 357. In some instances, each bottom slot 348 is positioned halfway in between a pair of top slots 347. As such, circumferential distance 357 may be equal to ½ of circumferential distance 358.

One or more of the above components (or their subcomponents) may be made from stainless steel and/or durable, high temperature materials known as "superalloys". A superalloy, or high-performance alloy, is an alloy that exhibits excellent mechanical strength and creep resistance at high temperatures, good surface stability, and corrosion and oxidation resistance. Superalloys may include materials such as HASTELLOY, alloy x, INCONEL, WASPALOY, RENE alloys, HAYNES alloys, alloy 188, alloy 230, INCOLOY, MP98T, TMS alloys, and CMSX single crystal alloys.

INDUSTRIAL APPLICABILITY

Gas turbine engines may be suited for any number of industrial applications such as various aspects of the oil and gas industry (including transmission, gathering, storage, withdrawal, and lifting of oil and natural gas), the power generation industry, cogeneration, aerospace, and other transportation industries.

Referring to FIG. 1, a gas (typically air 10) enters the inlet 110 as a "working fluid", and is compressed by the compressor 200. In the compressor 200, the working fluid is compressed in an annular flow path 115 by the series of compressor disk assemblies 220. In particular, the air 10 is compressed in numbered "stages", the stages being associated with each compressor disk assembly 220. For example, "4th stage air" may be associated with the 4th compressor disk assembly 220 in the downstream or "aft" direction, going from the inlet 110 towards the exhaust 500). Likewise, each turbine disk assembly 420 may be associated with a numbered stage.

Once compressed air 10 leaves the compressor 200, it enters the combustor 300, where it is diffused and fuel is added. Air 10 and fuel are injected into the combustion chamber 320 via fuel injector 310 and combusted. Energy is extracted from the combustion reaction via the turbine 400 by each stage of the series of turbine disk assemblies 420. Exhaust gas 90 may then be diffused in exhaust diffuser 510, collected and redirected. Exhaust gas 90 exits the system via an exhaust collector 520 and may be further processed (e.g., to reduce harmful emissions, and/or to recover heat from the exhaust gas 90).

As modern engine temperatures have increased, cracks or other deformations in combustor liners have become increasingly common. In particular, hot spots may develop in portions of the combustor liner adjacent an open passage leading into the combustion zone, such as a resonator tube. Such hot spots may occur due to the proximity to extreme high temperature areas such as the combustion zone. Components surrounding the resonator tube, such as a grommet assembly, may include certain cooling features to decrease the temperature in these hot spot locations. For example, grommets with a plurality of top cooling slots and bottom cooling slots may be coupled to the resonator tube to provide a passage for cooling air to the hot spot locations.

Grommet assemblies 330 may include a floating grommet 341 that features a plurality of top cooling slots 347 and bottom cooling slots 348. Cooling air may travel through the top cooling slots 347 of the floating grommet 341, past the outer surface 356 of the lower platform 352 of the floating grommet 341, and out through the bottom cooling slots 348. The cooling air may travel past the hot spot area 327 and thus lower the temperature of the combustor liner. The combination of cooling air passages may provide a controlled amount of air leakage to the hot spot.

The preceding detailed description is merely exemplary in nature and is not intended to limit the invention or the application and uses of the invention. The described embodiments are not limited to use in conjunction with a particular type of gas turbine engine. Hence, although the present disclosure, for convenience of explanation, depicts and describes a particular grommet assembly, it will be appreciated that the grommet assembly in accordance with this disclosure can be implemented in various other configurations to access the combustor interior, can be used with various other types of gas turbine engines, and can be used in other types of machines. Furthermore, there is no intention to be bound by any theory presented in the preceding background or detailed description. It is also understood that the illustrations may include exaggerated dimensions to better illustrate the referenced items shown, and are not consider limiting unless expressly stated as such.

What is claimed is:

1. A grommet assembly for a combustion chamber of a gas turbine engine, the grommet assembly comprising: a retaining shroud including an upper annulus having an inner surface; a retaining nut coupled to the retaining shroud, the retaining nut including a covering portion having an inner surface; and a grommet including a lower annular platform having a top surface, a bottom surface opposite the top surface, an outer surface extending between the top surface and the bottom surface, a plurality of top grooves extending radially along the top surface of the lower annular platform, and a plurality of bottom grooves extending radially along the bottom surface of the lower annular platform, a cylindrical platform extending from the top surface of the lower annular platform, the cylindrical platform having an outer surface, at least a portion of the lower annular platform of the grommet extending between the retaining nut and the retaining shroud, the inner surface of the covering portion of the retaining nut and the outer surface of the cylindrical platform of the grommet defining an upper gap, and the outer surface of the lower annular platform of the grommet and the inner surface of the upper annulus of the retaining shroud defining a lower gap, the upper gap in fluid communication with the lower gap.

2. The grommet assembly of claim 1, wherein the upper gap, the plurality of top grooves, the lower gap, and the plurality of bottom grooves define a passage.

3. The grommet assembly of claim 2, wherein the combustion chamber includes an exterior outer liner, an interior outer liner, a conduit inserted through the exterior outer liner and the interior outer liner, and the grommet assembly coupled to the conduit.

4. The grommet assembly of claim 3, wherein the passage is in fluid communication with a portion of the interior outer liner.

5. The grommet assembly of claim 3, further comprising a second grommet assembly including an elongated grommet, an outer retaining shroud, and an outer retaining nut, wherein the second grommet assembly is coupled to the conduit.

6. The grommet assembly of claim 5, wherein the grommet is coupled to the elongated grommet.

7. The grommet assembly of claim 1, wherein the lower annular platform of the grommet is configured to thermally expand between the retaining nut and the retaining shroud.

8. The grommet assembly of claim 1, wherein the width of each top groove is 0.04", the depth of each top groove is 0.04", the width of each bottom groove is 0.03", and the depth of each bottom groove is 0.03".

9. The grommet assembly of claim 1, wherein the grommet includes 12 top grooves and 12 bottom grooves, and each top groove and each bottom groove is a cylindrical groove.

10. The grommet assembly of claim 1, wherein each top groove is circumferentially offset from each bottom groove.

11. A combustion chamber of a gas turbine engine, the combustion chamber comprising: an outer liner and an inner liner, the outer liner and inner liner forming a combustion zone there between; a conduit inserted through the outer liner, the conduit having a channel in fluid communication with the combustion zone; a grommet assembly coupled to the conduit, the grommet assembly including a first fixture component including an upper annulus having an inner surface; a second fixture component coupled to the first fixture component, the second fixture component including a covering portion having an inner surface, a floating grommet including a lower annular platform having a top surface, a bottom surface opposite the top surface, an outer surface extending between the top surface and the bottom surface, a plurality of top grooves extending radially along the top surface of the lower annular platform, and a plurality of bottom grooves extending radially along the bottom surface of the lower annular platform, a cylindrical platform extending from the top surface of the lower annular platform, the cylindrical platform having an outer surface, at least a portion of the top grooves and at least a portion of the bottom grooves extending between the first fixture component and the second fixture component, the inner surface of the covering portion of the second fixture component and the outer surface of the cylindrical platform of the floating grommet defining an upper gap, and the outer surface of the lower annular platform of the floating grommet and the inner surface of the upper annulus of the first fixture component defining a lower gap, the upper gap in fluid communication with the lower gap.

12. The combustion chamber of claim 11, further comprising a plurality of conduits inserted through the outer liner, each conduit spaced circumferentially apart from each other along the circumference of the outer liner, and a plurality of grommet assemblies, each grommet assembly coupled to one of the conduits.

13. The combustion chamber of claim 11, wherein the upper gap, the plurality of top grooves, the lower gap, and the plurality of bottom grooves define a passage in fluid communication with the combustion zone.

14. The combustion chamber of claim 13, wherein the passage is in fluid communication with a portion of the outer liner.

15. The combustion chamber of claim 11, further comprising a resonator in fluid communication with the conduit.

16. The combustion chamber of claim 11, wherein the floating grommet includes 12 top grooves and 12 bottom grooves.

17. A grooved cooling grommet for a conduit within a combustion chamber for a gas turbine engine, the grooved cooling grommet comprising: a lower annular platform having a top surface, a bottom surface opposite the top surface, an outer surface extending between the top surface and the bottom surface at an outer circumferential end of the lower annular platform, and an inner circumferential end, a collar extending from the top surface of the lower annular platform adjacent the inner circumferential end of the lower annular platform, the collar having an outer surface located at an outer circumferential end of the collar, the outer surface of the collar circumferentially offset from the outer surface of the lower annular platform, a plurality of top grooves located in the top surface of the lower platform and a plurality of bottom grooves located in the bottom surface of the lower platform, each top groove and bottom groove extending radially from the outer surface of the collar to the outer surface of the lower platform; and wherein the plurality of top grooves are spaced equidistantly from one another along the circumference of the lower platform, the plurality of bottom grooves are spaced equidistantly from one another along the circumference of the lower platform, and each top groove is circumferentially offset from an adjacent bottom groove.

18. The grooved cooling grommet of claim 17, wherein the width of each top groove is 0.04", and the width of each bottom groove is 0.03".

19. The grooved cooling grommet of claim 17, wherein the depth of each top groove is 0.04", and the depth of each bottom groove is 0.03".

20. The grooved cooling grommet of claim 17, wherein the grooved cooling grommet includes 12 top grooves and 12 bottom grooves.

* * * * *